US006682262B2

(12) United States Patent
Caron et al.

(10) Patent No.: US 6,682,262 B2
(45) Date of Patent: Jan. 27, 2004

(54) FILL AND COMPACTION ROLLER USING REPLACEABLE CLEAT ASSEMBLIES WITH EXTENDED SERVICE LIFE

(75) Inventors: James O. Caron, Modesto, CA (US); Scott F. P. Caron, Salida, CA (US)

(73) Assignee: Caron Compactor Company, Modesto, CA (US)

( * ) Notice: Subject to any disclaimer, the term of this patent is extended or adjusted under 35 U.S.C. 154(b) by 0 days.

(21) Appl. No.: 09/846,082

(22) Filed: Apr. 30, 2001

(65) Prior Publication Data

US 2002/0048489 A1 Apr. 25, 2002

Related U.S. Application Data

(63) Continuation-in-part of application No. 09/565,824, filed on May 5, 2000, now abandoned.

(51) Int. Cl.[7] ..... E01C 19/26
(52) U.S. Cl. ..... 404/124; 404/128
(58) Field of Search ..... 404/122, 124, 404/128, 121; 37/452, 454, 456

(56) References Cited

U.S. PATENT DOCUMENTS

| | | | | |
|---|---|---|---|---|
| 3,922,106 A | | 11/1975 | Caron et al. | |
| 4,668,122 A | * | 5/1987 | Riddle | 172/122 |
| 4,919,566 A | | 4/1990 | Caron et al. | |
| H946 H | * | 8/1991 | Lonn | 404/121 |
| 5,217,322 A | * | 6/1993 | Corcoran et al. | 172/554 |
| 6,018,896 A | * | 2/2000 | Adamic | 37/456 |

FOREIGN PATENT DOCUMENTS

EP 0172019 * 2/1986

* cited by examiner

*Primary Examiner*—Gary S. Hartmann
(74) *Attorney, Agent, or Firm*—Donald N. MacIntosh

(57) ABSTRACT

A companion roller for mounting on a driven compaction vehicle is equipped with both destructive and tractive, highly wear resistant cleat assemblies. The later includes readily removable wear caps with bulbous corner portions and broad wear faces. Anti twist projections and complementary recesses at the interface of the wear caps and support bases reduce relative movement between the parts under severe working forces.

3 Claims, 17 Drawing Sheets

FILL AND COMPACTION ROLLER USING REPLACEABLE CLEAT ASSEMBLIES WITH EXTENDED SERVICE LIFE

This application is a continuation-in-part of application Ser. No. 09/565,824, filed May 5, 2000 now abandoned.

FIELD OF THE INVENTION

This invention generally concerns compaction machinery such as a roller or wheel for mounting upon a driven compactor vehicle or tractor, the roller having both destructive and tractive characteristics adapted to break up, crush, grind and compact throwaway materials commonly delivered to a sanitary land fill operations. More particularly this invention is characterized by cleat assemblies including removable wear caps configured for a long service life.

BACKGROUND OF THE INVENTION

Compaction rollers and wheels used on landfill operations and particularly sanitary landfill operations are equipped generally with cleats or feet of the type for grinding and crushing materials to reduce the size and bulk of the material. As shown in the assignee's prior patents, U.S. Pat. No. 3,922,106 and 4,919,566, an earth and sanitary fill compaction roller has been shown employing two different types of feet having a replaceable wear cap as a part of the cleat assemblies. The wear caps are welded to a base portion of the assembly, which in turn is welded to the roller as shown in U.S. Pat. No. 3,922,106. The wear caps in U.S. Pat. No. 4,919,566 are readily removable from the base portion of the assembly using common tools available at the job site. It has been observed that due in large degree to manufacturing tolerances that the use of removable wear caps coupled to a fixed base, in severe service exposes the assembly to twisting forces which in time materially reduce the service life of the wear cap and cleat assembly. In the '566 patent, a cleat assembly was disclosed including means for restraining twisting of the wear cap relative to the base, which function entirely satisfactory with compaction equipment then operating in the 70,000 lbs. gross weight class. Improvements in the cleat assembly are desired for use on compaction rollers mounted on compaction machines now furnished in the 100,000 to 120,000 lbs gross vehicular weight class.

More particularly, the compaction vehicles of the higher operating weights now coming into service apply substantially more torque to the compaction rollers via their larger engines and transmissions than was the case with compactors that were 30,000 to 50,000 lbs. lighter in gross vehicle weight. Moreover, landfill operators expect very long service life of the compaction rollers and cleat assemblies, some required assurances that these components will render a service life on the order of 20,000 hours. Thus, it is highly desirable to accommodate in the cleat assemblies on the compaction rollers the higher torque than tractive forces applied by the extra heavy duty compaction machinery now entering into service.

SUMMARY OF THE INVENTION AND OBJECTS

In general, an improved compaction roller carries cleat assemblies comprising a rigid mounting pad assembly to be welded to a rigid cylindrical body and a bracket integral to the base portion protruding generally outwardly therefrom. At least one coupling opening extends transversely through the bracket. A detachable wear cap unit is releaseably coupled to the base, the cap having a generally hollow body, including radially outwardly converging outer sidewalls and having broad tractive faces with enlarged end portions. At least one pair of aligned openings are formed through the sidewalls and align able with the coupling openings for receiving coupling means there through. Coupling means are disposed acting between the bracket and the wear cap unit. The cleat assembly being characterized by means restraining twisting of the wear cap unit with respect to said base portion, and including a plurality of apertures and complementary projections arranged on said base portion and said wear cap unit and positioned outwardly on said base portion on said bracket. The wear cap including transverse end walls extending between the end portions of said side walls and merging therewith into enlarged corner portions protruding outwardly from the general plane of the sidewalls thereby defining a broad tractive working face.

In general it is an object of the present invention to provide an improved fill and compaction roller having readily replaceable cleat assemblies compatible with extra heavy duty compaction equipment utilizing high horsepower and torque forces.

It is another object of the present invention to provide an improved cleat assembly in which the wear cap can be readily replaced so as to avoid the wearing W away the mounting base carrying such wear cap.

Another object of the invention is to provide a cleat assembly of the type described having broad tractive working faces.

It is a further object of the invention to provide an improved cleat assembly for fill and compaction roller characterized by means restraining twisting between the wear cap and base.

It is yet an additional object of the invention to provide a cleat assembly for a fill and compaction roller including a readily removable cap units or shoes serving to provide to the roller traction and a demolition functions.

An additional object of the invention is to provide a cleat assembly having a readily removable cap unit serving to engage upon a base in a manner inhibiting twisting of the cap unit with respect to the base.

The foregoing and other objects of the invention will become more readily evident from the following detailed description of preferred embodiments when considered in conjunction with the drawings.

DESCRIPTION OF THE PREFERRED FORMS OF THE INVENTION

Figure 1:
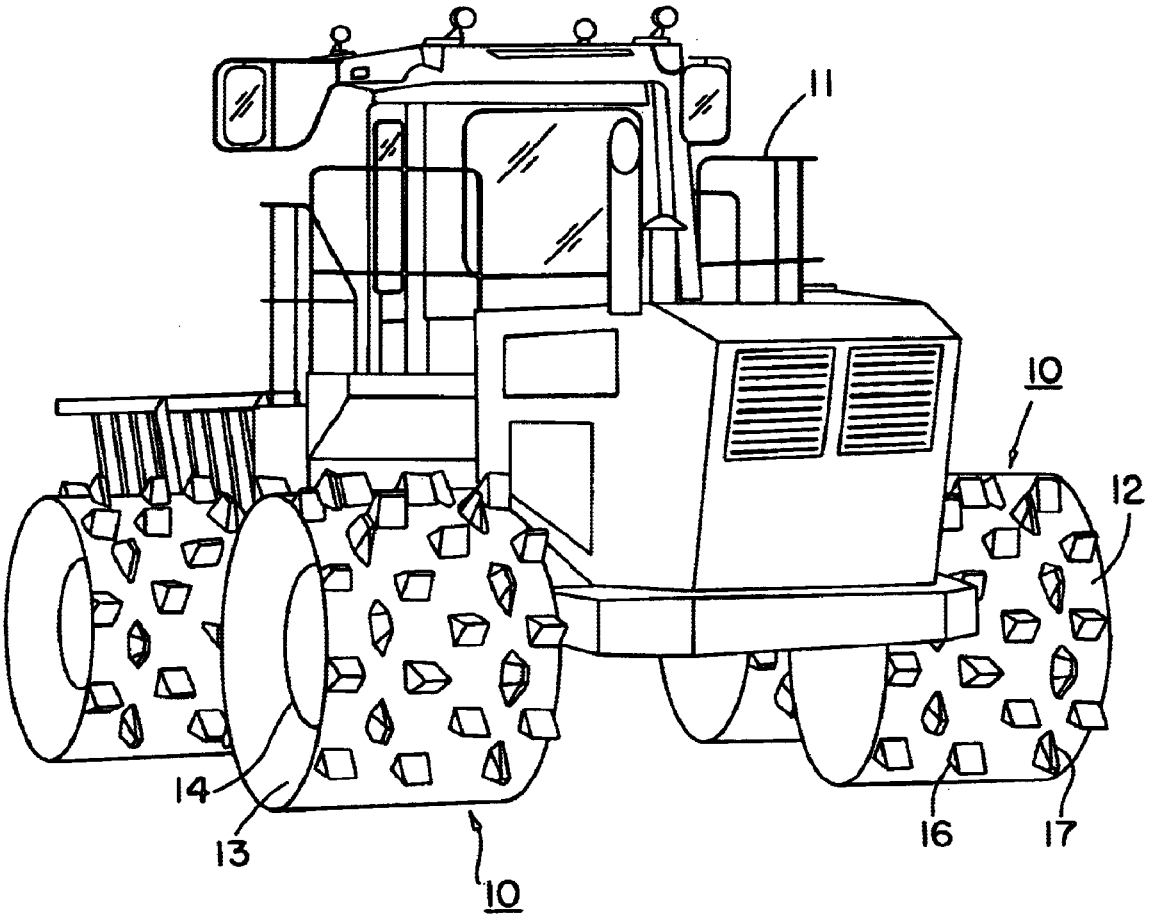
FIG. 1 is a perspective view of the rear of a sanitary landfill trash compactor equipped with compaction rollers having mounted thereon the cleat assemblies, all made in accordance with the principles of the present invention.

A compaction roller 10 constructed according to the present invention is illustrated in FIG. 1 mounted upon a power-driven trash compaction vehicle 11 of high gross vehicular weight, the roller 10 normally being deployed in sets of four as shown. The compaction roller 10 includes a rigid cylindrical body or rim 12 connected to a centrally disposed conical web 13 which in turn is rigidly secured to central wheels structure 14 shown diagrammatically but may be constructed according to U.S. Pat. No. 3,724,342 assigned to Caron Compactor Company to incorporate cushioning elements and the like.

The wheel or roller 10 is shown mounted upon a very heavy duty compactor vehicle, one in the gross vehicle weight range of 70,000–120,000 lbs. The high vehicular weights are desirable to achieve high compaction densities in the sanitary land fill thereby to increase the capacity life of the landfill.

The cylindrical rim 12 of each of the four wheels shown in FIG. 1 is equipped with cleat assemblies 16–17 as described more fully below which are arranged in rows as shown. For ease of reference the cleat assemblies 16 referred to as traction cleats being that the cleat is provided with broad flat bases presented to the direction of wheel rotation. The cleat assemblies 17 may be referred to as contour cleats being that they are oriented on the rim 12 With the long dimension of the cleat assembly extending in the direction of travel and their configuration follows the contour of the wheel rim. Both the contour cleats 17 and the traction cleats 16 have broad faces oriented in the direction of travel, and thus, both provide substantial traction effect for the wheel or if viewed in another way, the driving force applied by the transmission and a motor of the compactor are distributed onto both the traction and contour cleats which together serve to crush and grind materials normally deposited in a landfill.

Figure 2:
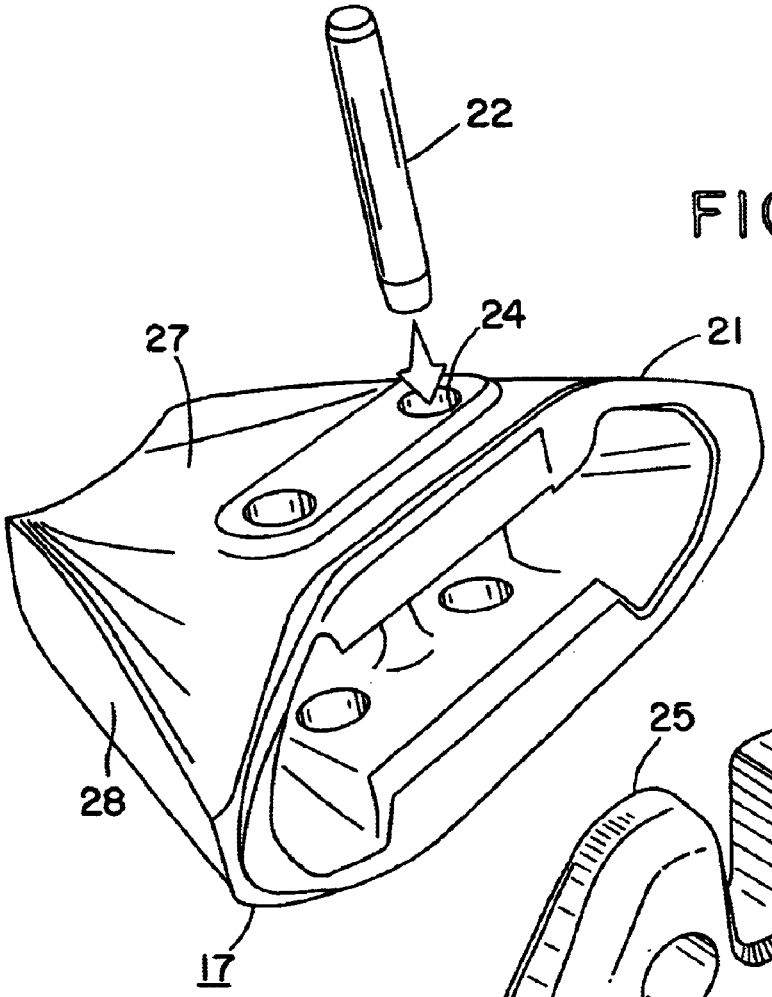
FIG. 2 is a perspective view on an enlarged scale of a contour type wear cap having broad tractive working end faces.
Figure 3:
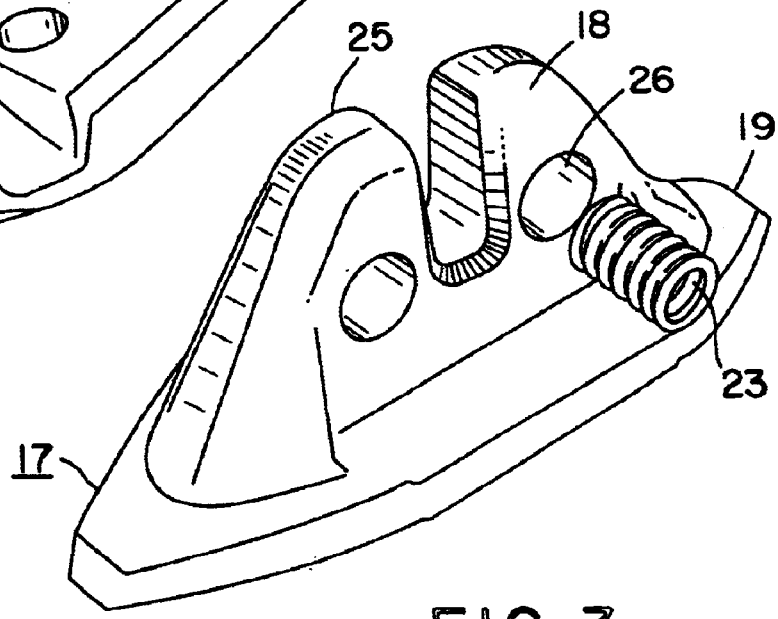
FIG. 3 is a view on the scale of FIG. 2 showing the contour cleat base.

As shown in FIGS. 2 and 3, the contour cleat assembly 17 includes a rigid mounting pad unit 18 having a base portion 19 curved to conform to the curvature of cylindrical rim 12 so as to be welded to the rigid body formed by the rim. It will be understood that the metallurgical composition of the cast steel mounting pad 18 is such as to facilitate welding to the steel rim. On the other hand, the metallurgical composition of the cast steel wear cap 21 is substantially harder and cast from a steel formulation selected to resist abrasion over a long service life. This material is not conducive to welding and for this reason, a mechanical connection is highly desirably so that a very hard wear cap may be coupled to a relatively softer, readily weldable, supporting base 18. Serving to maintain the wear cap 21 releaseably secured to the mounting pad 18, faster means including a pin 22 and a coil spring member 23 are mountable in the associated apertures 24 and 26, respectively, as taught in the assignee's U.S. Pat. No. 4,919,566, FIGS. 26–33. Although but a single pin 21 and capture spring 23 are shown in FIGS. 2 and 3, it is apparent that a pair may be usefully received in the contour cleat 17 to promote a good fit between the parts. It will be seen that the central bracket 25 is cast integral with the base portion 19 and protrudes generally radially outwardly therefrom.

Figure 4:
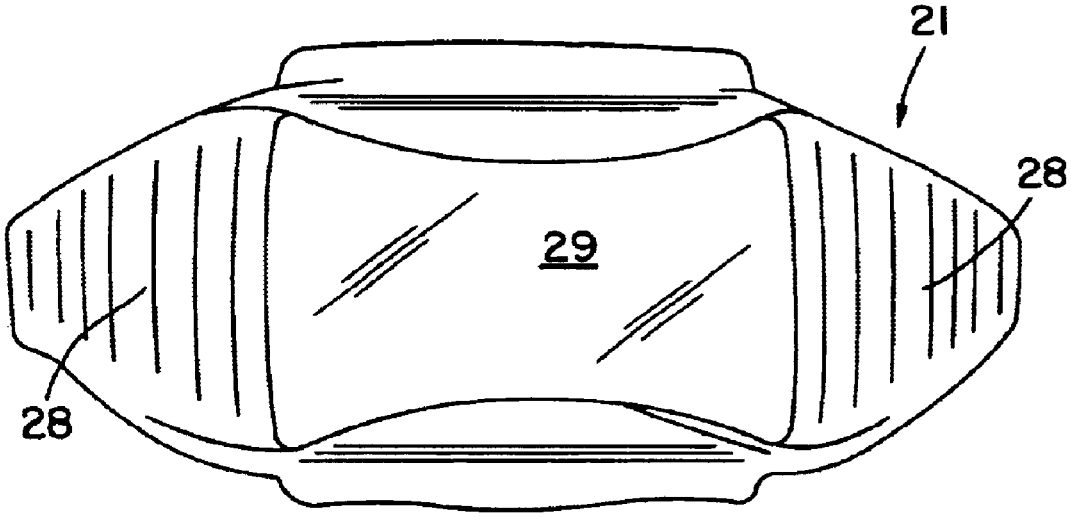
FIG. 4 is a plan view from above of the contour cleat shown in FIGS. 2 and 3.

The wear cap unit 21 has a generally hollow body including sloping upwardly converging outer side walls 27 and end walls 28 which at the edges bulge outwardly so that the end walls 28 taper from a narrow portion adjacent the base mounting pad 19 to a wider top end portion 29 as shown in FIG. 4. This configuration presents broad traction faces 28 to the contour cleat 17 and further provides bulbous metal masses along the end faces 28 to resist abrasion and wear over the desired along service life of the wear cap. The top wall 29 of the wear cap 21 is thus configured to have its narrowest dimension near the cleat center portion with the widest dimensions near the juncture with the end walls 28 providing substantial masses of steel in an ideal position to resist abrasive wear.

Figure 5:
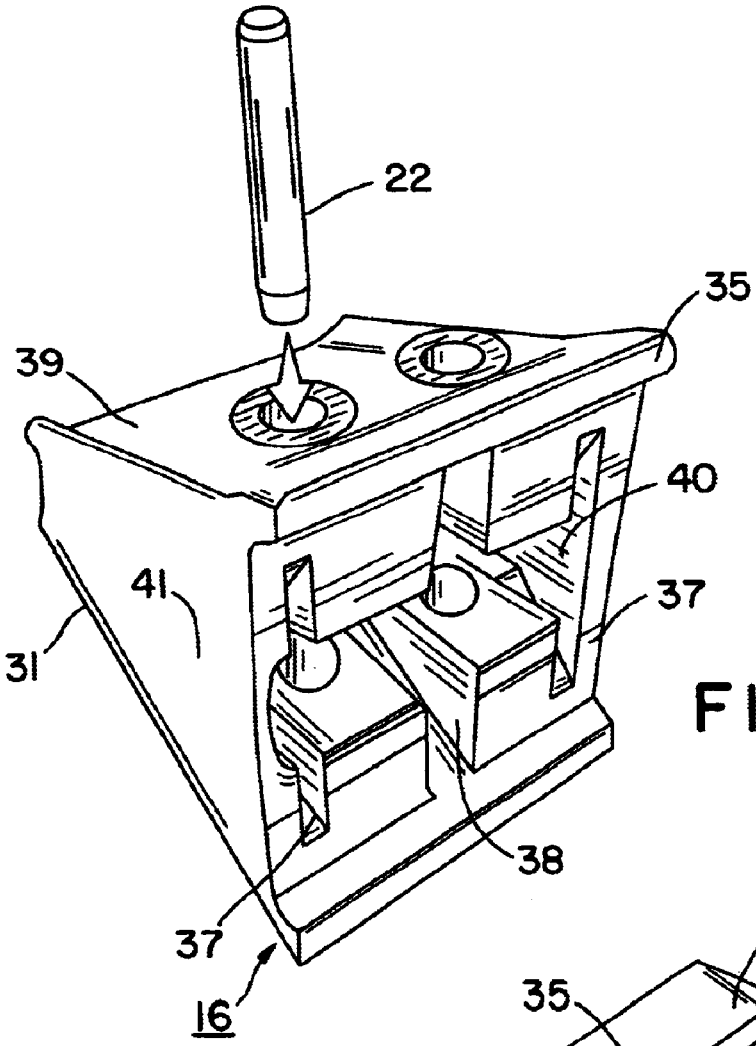
FIG. 5 is an enlarged perspective view, like FIG. 2, showing the wear cap of a traction foot of the present invention having broad tractive working faces.
Figure 6:
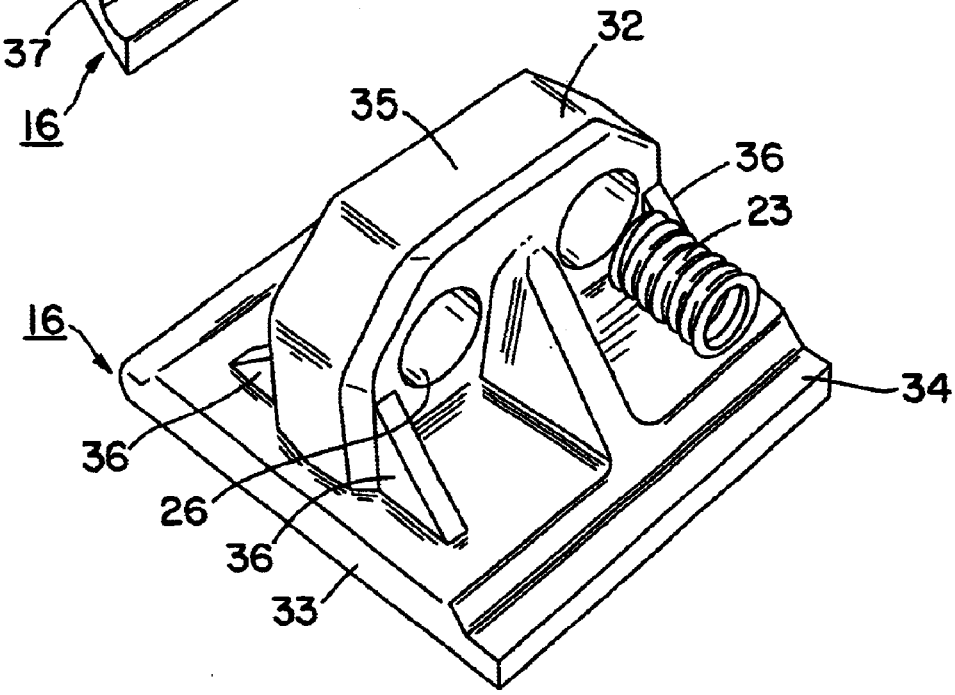
FIG. 6 is a perspective view of the adapter base accommodating the wear cap of FIG. 5.
Figure 7:
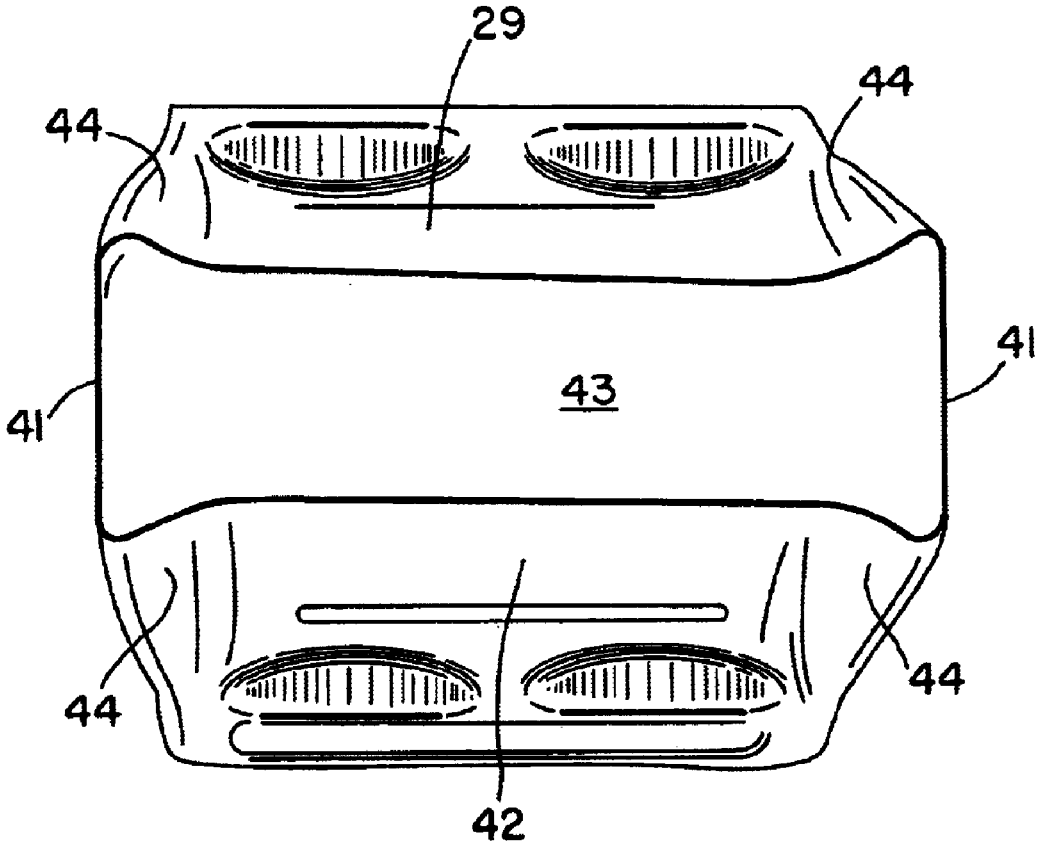
FIG. 7 is a plan view from above of the traction cleat shown in FIGS. 5 and 6.

Referring now specifically to FIGS. 5, 6 and 7, the traction cleat 16 includes a wear cap 31 and a rigid mounting pad unit 32 having a base portion 33 curved to conform to the curvature of the cylindrical rim 12 to as to be welded to the rigid body formed by the rim. The metallurgical composition of the wear cap 31 and adaptor base 32 is the same as that referred to in connection with the corresponding component parts of the contour cleat 17. The pad 33 includes integrally formed bracket 35 which extends generally outwardly from the pad 33 and is mounted generally centrally of the pad. At its edges the pad is recessed as indicated at 34 along two parallel sides so as to receive skirt-like extensions 35 of the side wall of the wear cap to thus protect the mounting pad unit 32. A plurality of anti-twist gussets 36, triangular in shape are formed between the pad 33 and central bracket 32, three being indicated on each side of the bracket. Complimentary gusset receiving recesses 37, 38 are formed in the wear cap 31 so as to enclose the gussets 36 in a snug fit. A central recess 40 is configured to receive the central bracket 35.

The wear cap 31 includes sloping, upwardly converging side walls 39, 42 and end walls 41. The end walls 41 converge with the side walls 39, 42 in enlarged outwardly protruding, bulbous corner portions 44 and thus the top wall 43 has its broadest portions arranged adjacent the end walls 41 and the narrower portion centrally located. This configuration preserves the desired tractive effect of the cleat while permitting a long service life by positioning substantial metal masses at the four corners of the wear cap which has been found in use to abrade more rapidly than the central portions of the wear cap. It will be apparent that the complimentary recesses and anti-twist elements 36 between the wear cap and adaptor provide for a snug and highly twist-resistant fit being that the elements 36 that are disposed adjacent to the end portions of the bracket 32.

Fastener means 22, and 23 as shown are provided to releaseably secure the adaptor base to the wear cap in the manner already described.

Figure 8A:
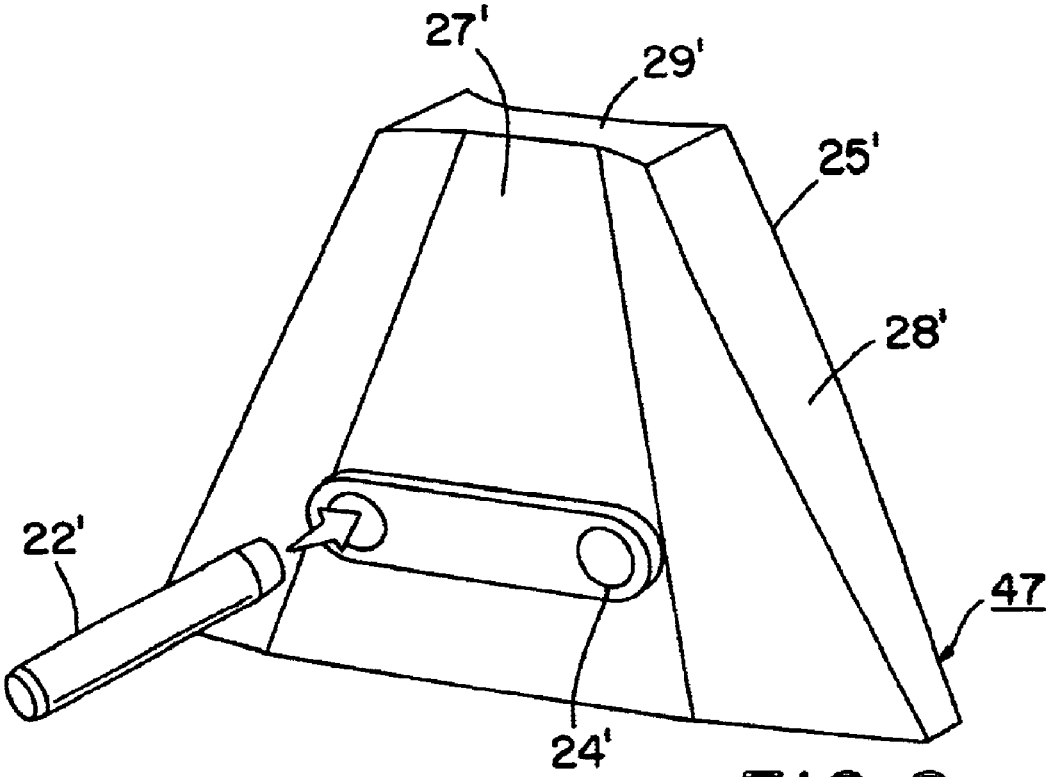
FIGS. 8*a* and 8*b* are related perspective views of the contour cap, FIG. 8*a*, and base assembly, FIG. 8*b*, equipped with anti-twist pintles.
Figure 8B:
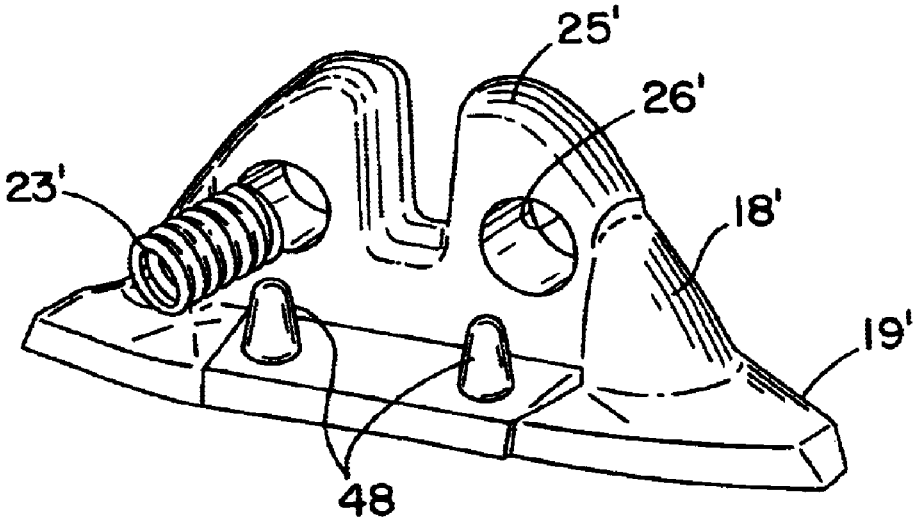

Referring to FIG. 8, another embodiment of contour cleat 47 is shown and for the reason that it comprises elements previously described, the same reference numbers will be used but with the prime symbol. As shown, the contour cleat assembly 47 includes the rigid mounting pad 18' having a base portion 19' and a central bracket 25' cast integral with the base portion to protrude generally radially outwardly therefrom.

Figure 9:
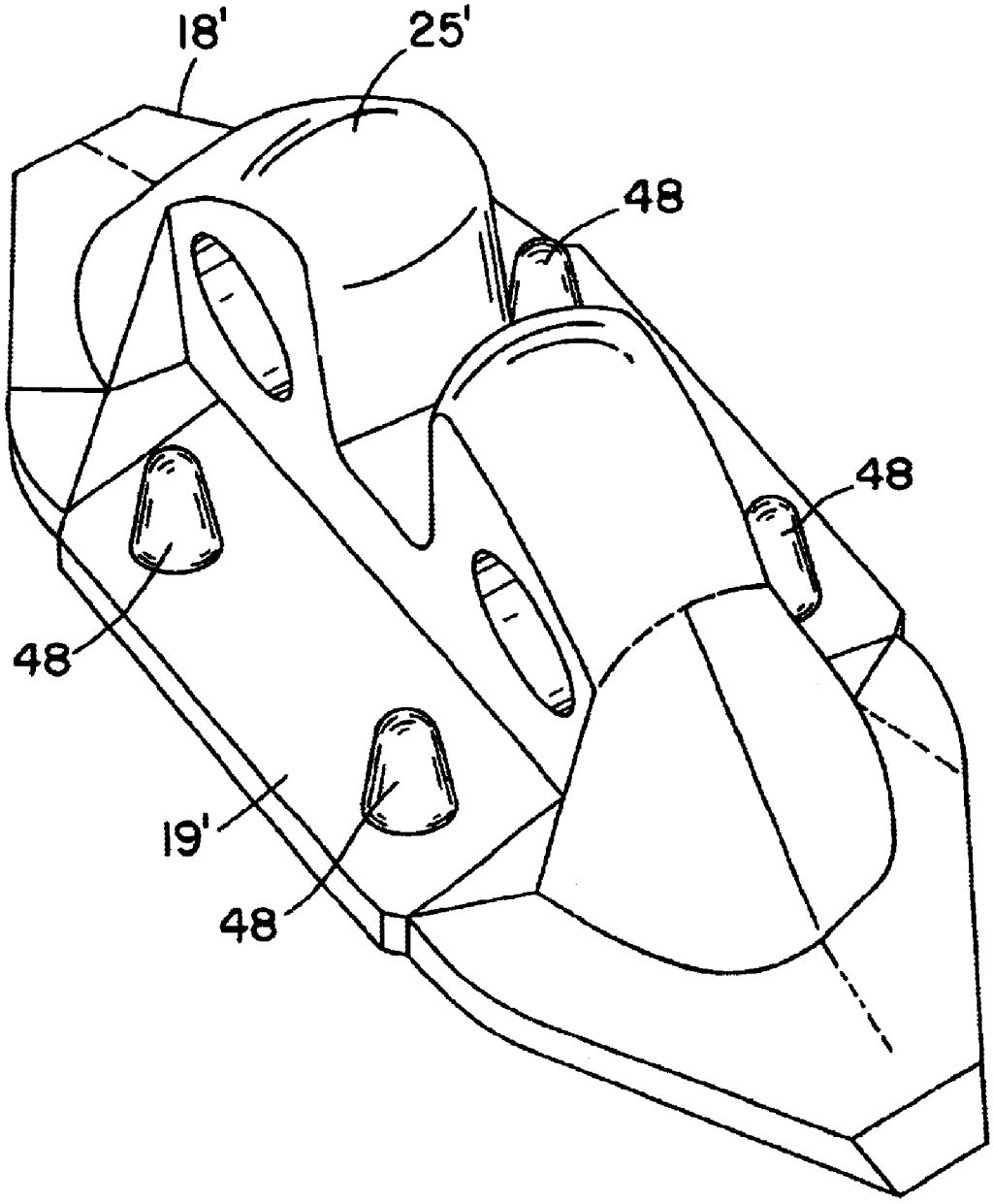
FIG. 9 is a perspective view from above of the adaptor base as shown in FIG. 8*b*.

The contour cleat 47 includes the wear cap unit 21' configured as previously described and is provided with apertures 24' to receive the holding pin 22' whereas the adaptor base 18' is provided with the aperture 26' to receive the coil retaining spring 23'. A plurality of anti-twist elements having a general configuration of tapered billets are positioned on the base 19' two on each side of the central bracket 25'. The billets or pintles 48 may be tapered upwardly as shown in FIGS. 8 and 9 or may be substantially cylindrical and of uniform diameter according to foundry practice. Their height may be on the order of ¾' to 1½' in length. Although four anti-twist billets 48 are illustrated, this number may be varied so that two billets will be positioned on one side of the bracket 25' and but a single billet on the opposite side. Further, it is practical to use two billets 48 with one positioned on either side of the bracket 25' or both on the same side of the bracket 25'.

Complementing the billets or pintles 48 the wear cap 21' is equipped with receiving cavities configured to fit closely with the billet elements 48. Thus, when the wear cap 21' is mounted on the adaptor 18' the billets 48 are received in their complementary recesses and the coupling elements 22, 23 connected thereto serve to unite the parts together in a tight relationship resisting twisting of the wear cap 21' with respect to the adaptor 18'.

Figure 10A:
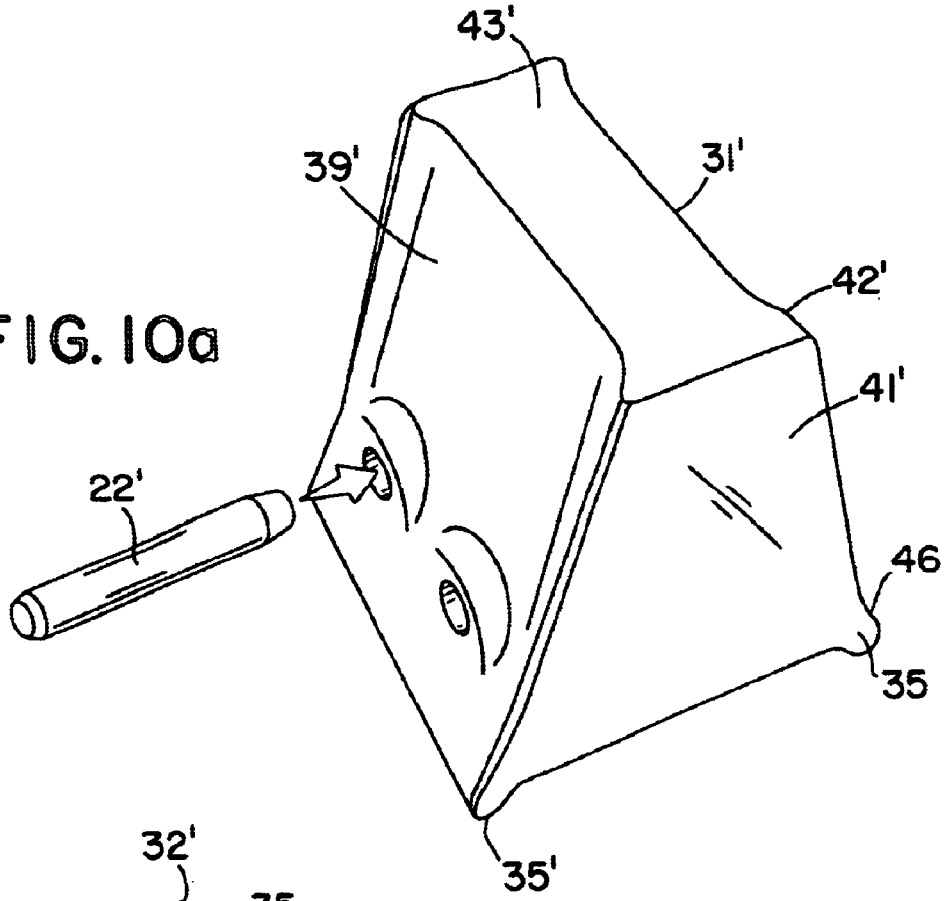
FIGS. 10*a* and 10*b* are related perspective views of the traction foot cap, FIG. 10*a*, and base, FIG. 10*b*, of the present invention equipped with the pintle anti-twist elements.
Figure 10B:
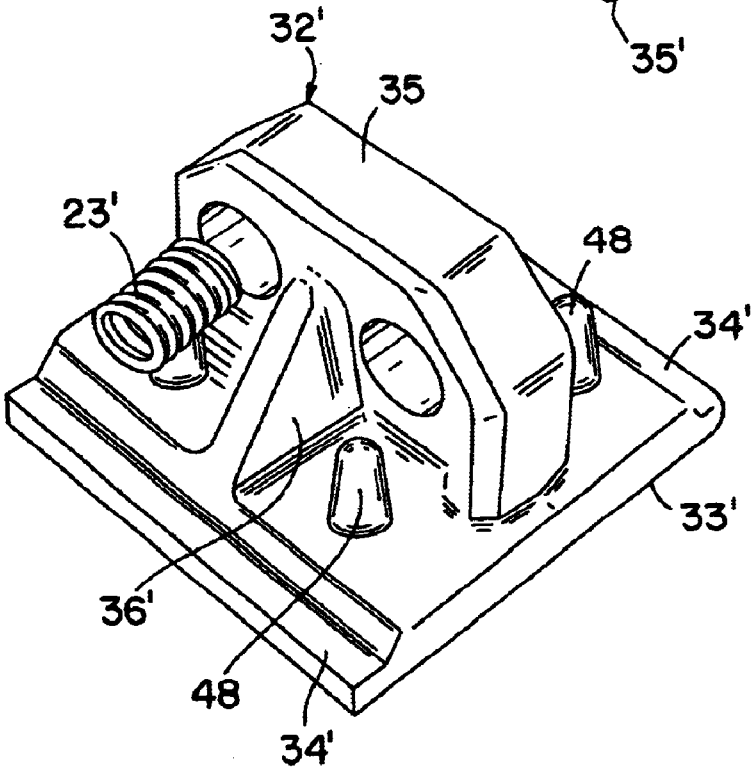
Figure 11:
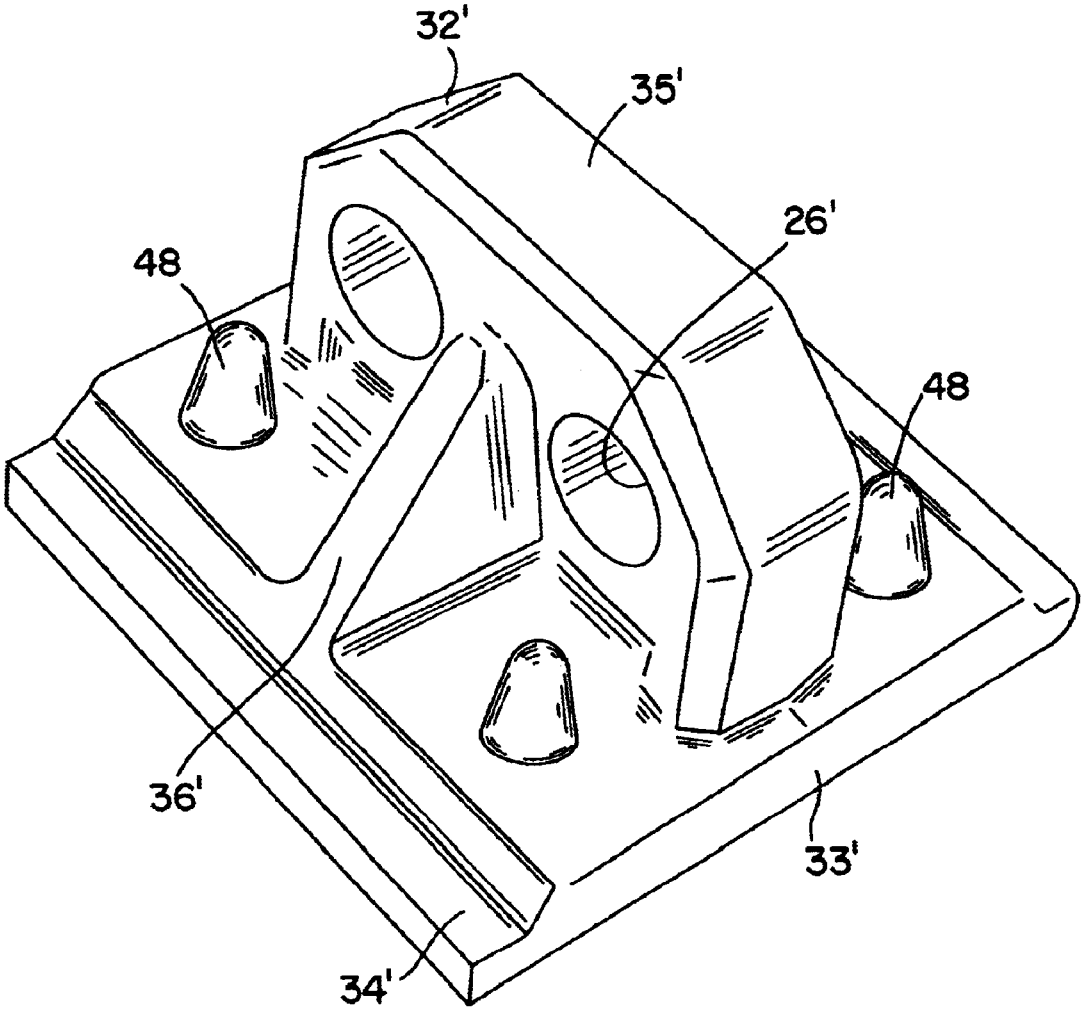
FIG. 11 is an enlarged perspective view from above of the adaptor base for the traction foot as shown in FIG. 10*b*.

Referring now specifically to FIGS. 10 and 11, another preferred form of traction cleat 46 is illustrated and includes parts previously described, thus designated with the reference numerals plumed. The traction cleat 46 includes a wear cap 31' and a rigid mounting pad unit 32' having a base portion 33' for welding to the wheel rim. The pad 33' includes the integrally formed central bracket 35' which extends generally outwardly from the pad 33' as shown. At its edges the pad is recessed as indicated at 34' to receive skirt-like extensions 35' of the sidewalls 39', 42'. A plurality of anti-twist billets or pintles 48 are formed on the pad 33' and project generally upwardly on both sides of the central bracket 35'. Complementary shaped recesses are formed in the wear cap 31' so as to receive the billets or pintles 48 therein. A central recesses 37' is provided for receiving the gusset anti-twist elements 36'. On the traction cleat 46, the billet elements 48 are indicated as being deployed in pairs on either side of the central bracket, but it is practical to achieve substantially the same anti-twist effect by using three integral elements and as the application dictates or two elements, one each side of a central bracket. The wear cap is provided with apertures or recesses for receiving the pintle elements.

Figure 12:
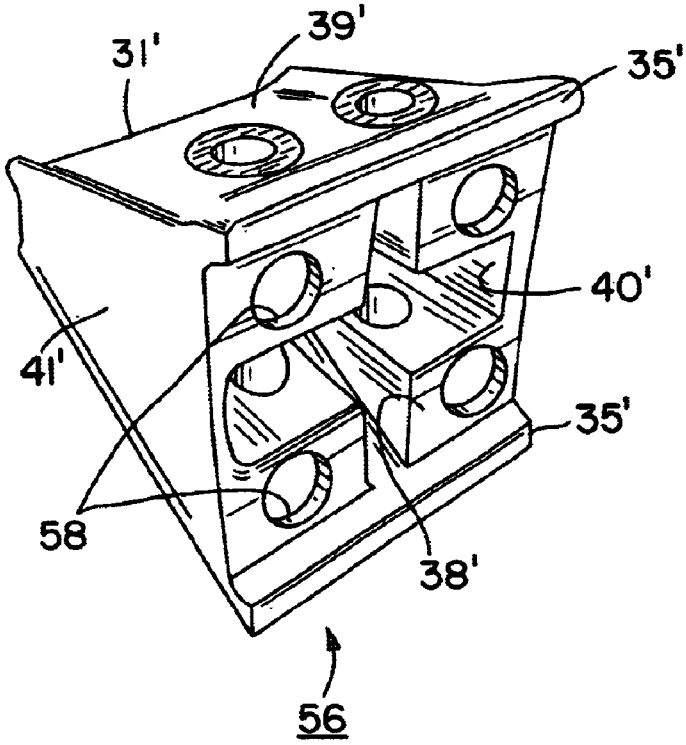
FIGS. 12 and 13 are perspective views of still another embodiment of the invention showing dowels and recesses on the base adaptor and wear cap, respectively, for anti-twist purposes.
Figure 13:
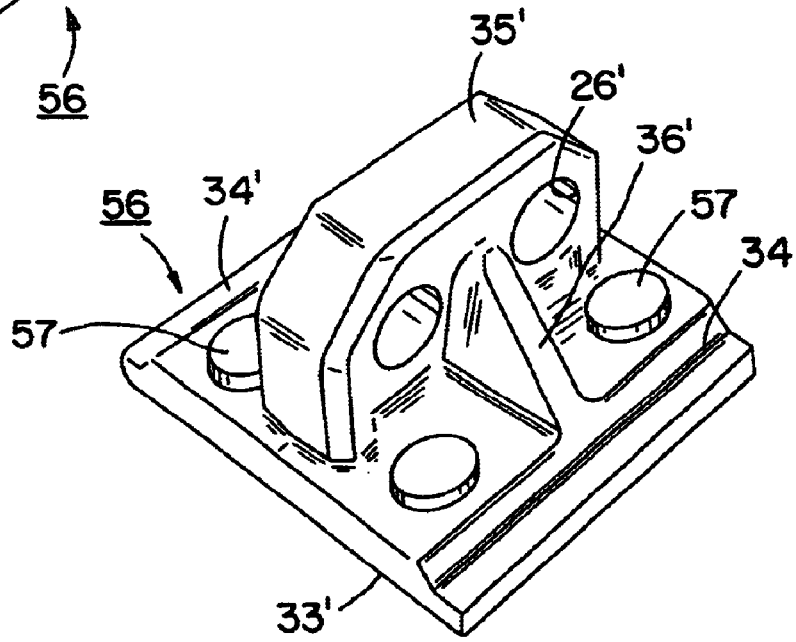

Still another preferred form of the traction cleat 56 is shown in FIGS. 12 and 13. As was the practice above, similar parts have been designated with similar reference numerals accompanied by a prime symbol. Similar parts previously described and contained in the traction cleat 56 include the wear cap 31', mounting pad unit 32', base portion 33', central bracket 35', recesses 34', wall extensions 35', and sidewalls 39' and 42'. The recesses 30' and 40' are also present in the wear cap 56. A plurality of anti-twist stub posts or bosses 57 and complementary recesses 58 are disposed respectively on the adaptor pad 33' and in the under side of the wear cap 41'. It will be apparent that the complementary recesses and anti-twist elements 58 and 57 when fitted together interact to permit the wear cap 31' and adaptor base 33' to achieve a highly twist-resistant fit between the elements. Faster means (not shown) are provided as in the instance of the embodiments illustrated in FIGS. 5, 6, and 10 to releaseably secure the adaptor base to the wear cap in the manner already described. Although four anti-twist stub posts or bosses 57 are illustrated together with the associated recesses 58, this number may be varied so that either 3 or 2 stub posts may be disposed on the adaptor pad 33' as the need dictates. It is to be understood that the receiving cavities 58 and the wear cap are configured to fit closely with the stub post or boss elements 57 so that the parts may unite in a tight relationship resisting twisting of the wear cap with respect to the adaptor 33'. The stub post or boss 57 configuration with the associated recesses 58 can be applied to the contour cleat, e.g., applied to the embodiment shown in FIGS. 8 and 9. In that instance the stub post 57 would exist in place of the billets or pintles 48 and their associated recesses.

Figure 15:
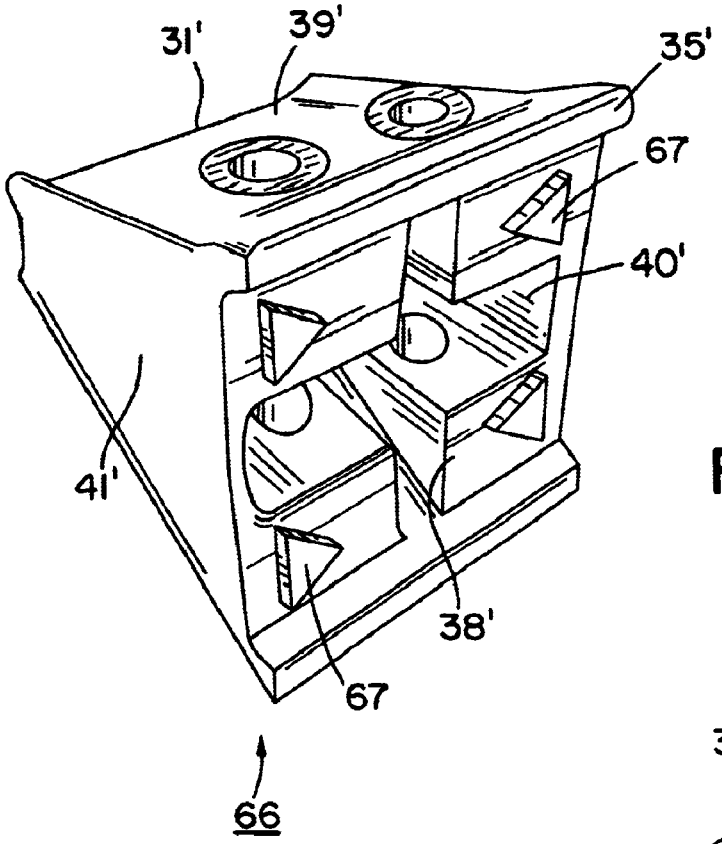
FIGS. 14 and 15 show yet another embodiment of the invention with recesses on the base adaptor and protruding elements on the wear cap for anti-twist purposes.
Figure 14:
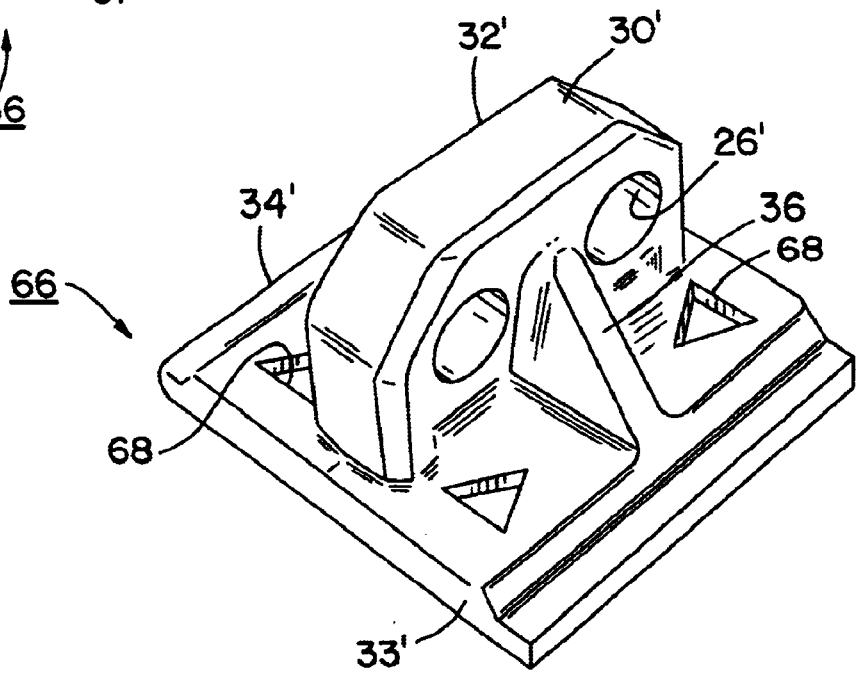

Referring now specifically to FIGS. 14 and 15, yet another preferred form of traction cleat 66 is disclosed. Parts previously described above are enumerated in FIGS. 14 and 15 with the reference numerals primed, as practiced above. These will not be further described. A plurality of anti-twist wedges 67 are formed on the wear cap 31', the wedges 67 being disposed on the undersurface so as to project outwardly therefrom. Triangular recesses 68 are disposed in the pad surface 33' to receive the wedge elements. When the wear cap 31' is drawn tightly into the adaptor pad 32', the wedge protrusion 67 seat snugly within the recesses 68 to provide for the substantial anti-twist resistance within the two piece cleat unit 66. Although an exemplary four anti-twist elements are illustrated, actual practice may dictate few than four will serve satisfactory the desired purposes.

Figure 16A:
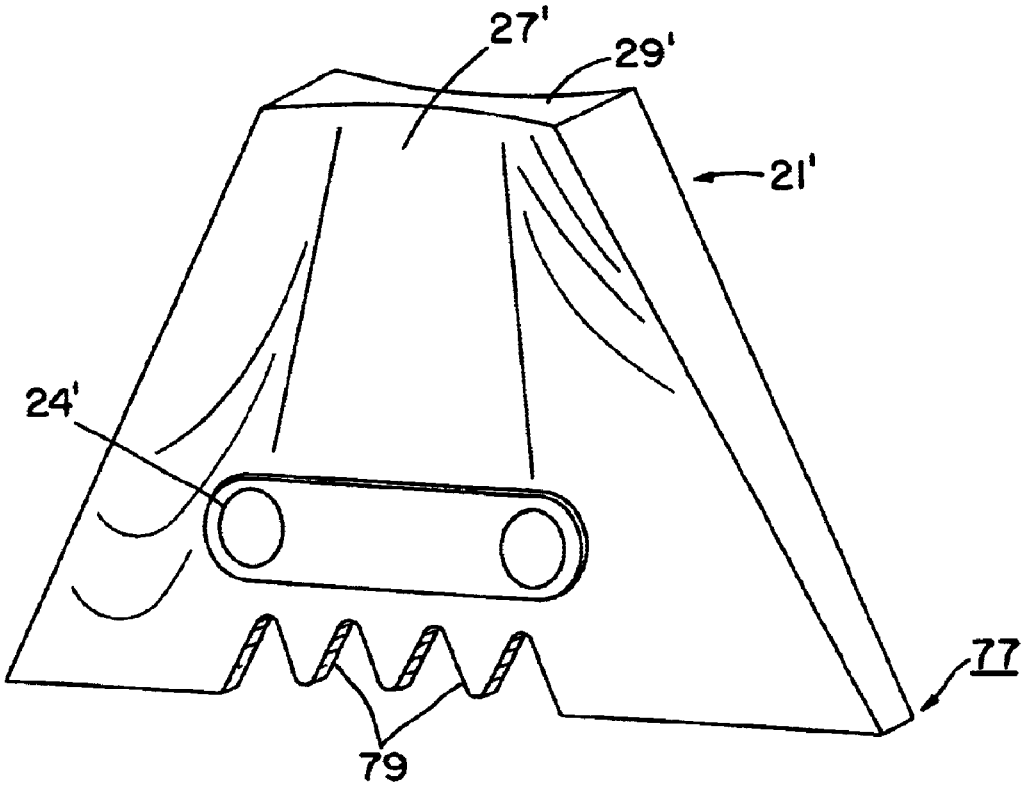
FIGS. 16*a* and 16*b* are related perspective views of the wear cap, FIG. 16*a*, and adaptor, FIG. 16*b*, of the contour foot showing another preferred embodiment of the anti-twist provisions.
Figure 16B:
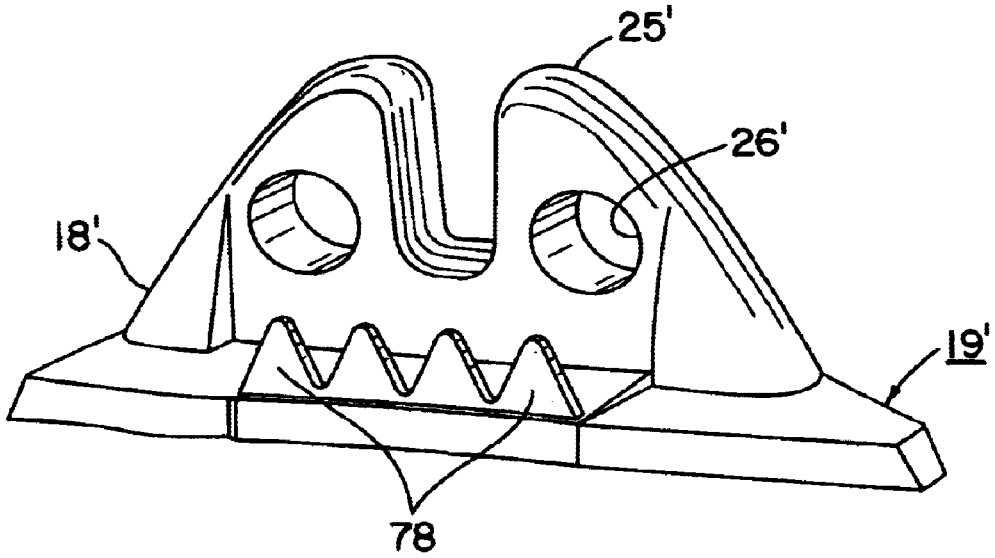
Figure 17:
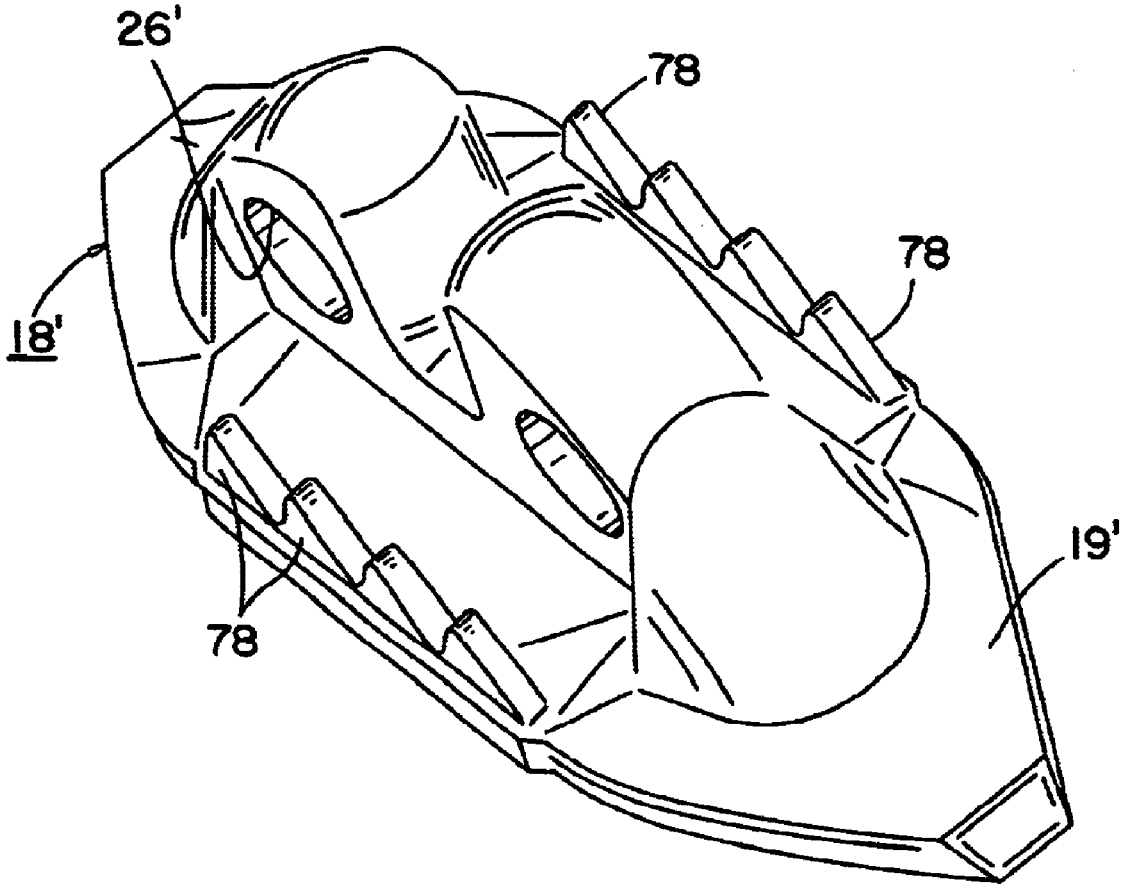
FIG. 17 is an enlarged perspective view from above of the adaptor base shown in FIG. 16*b*.

Referring to FIGS. 16 and 17, another embodiment of contour cleat 77 is shown and for the reason that it comprises elements previously described, the same reference numbers will be used with the prime symbol. A plurality of anti-twist elements 79 having a general configuration of a greatly enlarged sawtooth are positioned on the central outer edge of the mounting base or pad 19' and correspondingly on the lower portion 79 of the walls 27' of the wear cap 21'.

Whereas when formed integrally with the pad 19', the sawtooth anti-twist element 78 protrude upwardly and are shown as comprising four projections. On the wear cap 21', the bottom or skirt portions of the sidewalls 27' are recessed so as to receive the four projections from the adaptor pad 19'. It will be apparent that when the wear cap and adaptor pad are drawn together, the sawtooth elements 78,79 interfit and provide the desired highly twist-resistant interconnection between the parts.

Figure 18A:
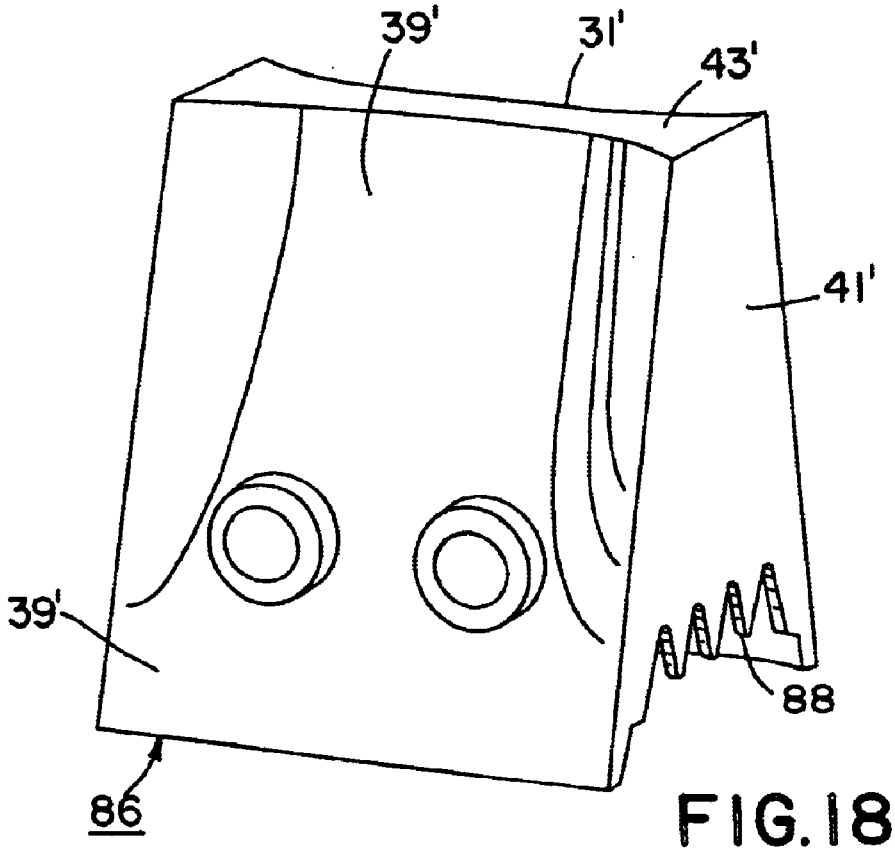
FIGS. 18*a* and 18*b* are related perspective views of the traction foot cap, FIG. 18*a*, and base, FIG. 18*b*, assembly showing another preferred embodiment of the anti-twist means in the environment of a traction foot.
Figure 18B:
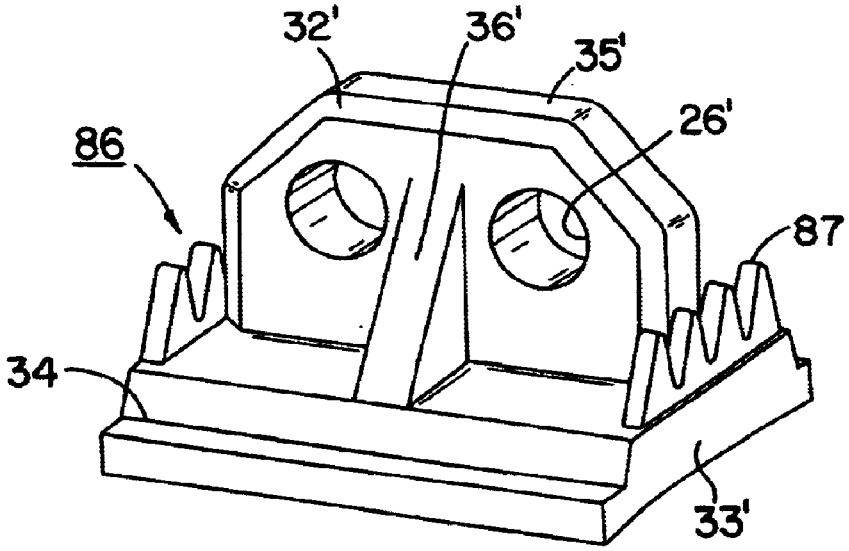
Figure 19:
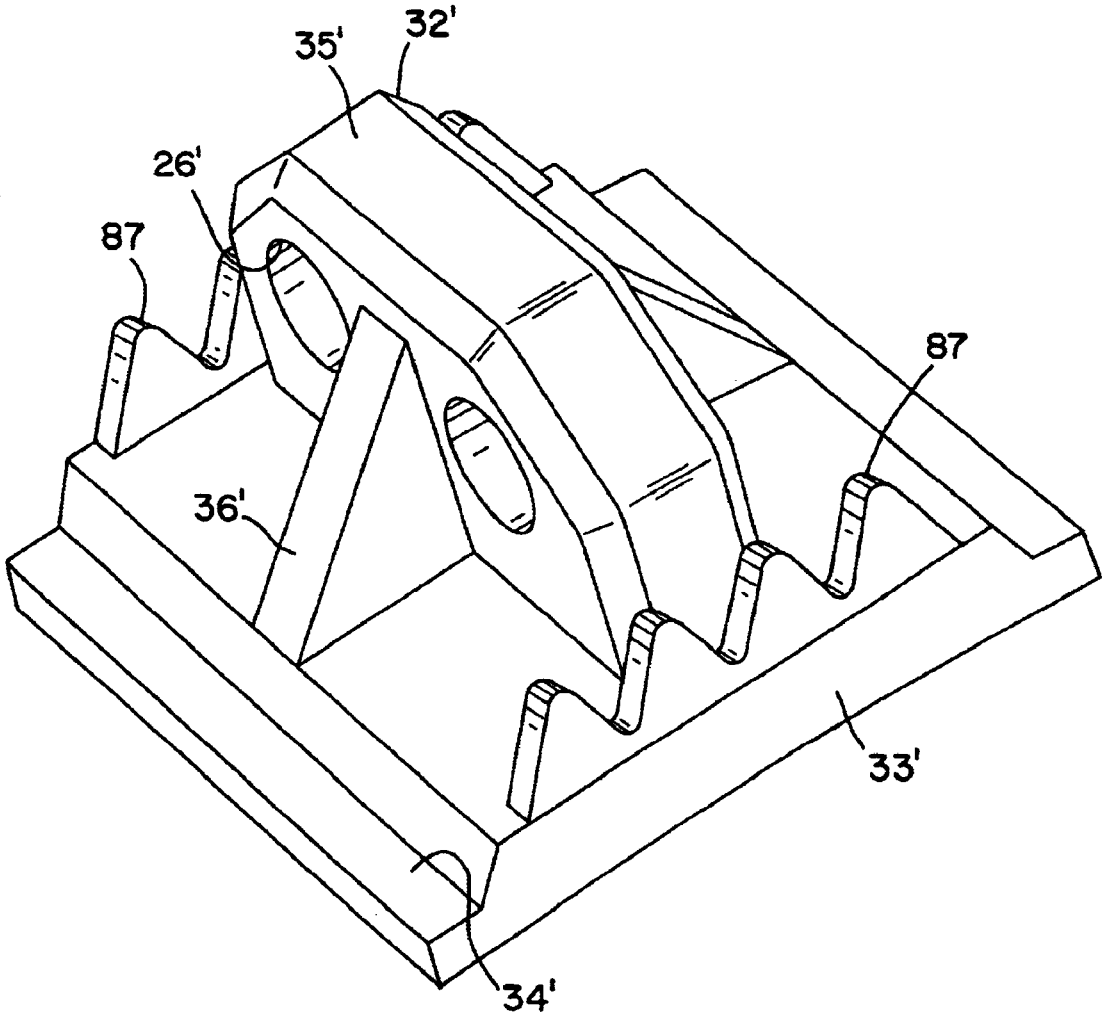
FIG. 19 is an enlarged perspective view from above of the adaptor base of the embodiment shown in FIG. 18*b*.

Referring now to FIGS. 18 and 19, still another preferred form of traction cleat 86 is disclosed. Parts previously described above are enumerated in FIGS. 18 and 19 with reference numerals prime, as practiced above. These will not be further described. A plurality of anti-twist, enlarged sawtooth like elements 87 and 88 are arranged on the wear cap 31' and the adaptor base 32'. The anti-twist, sawtooth like elements 87, 88 are provided respectively on the sidewalls of the pad 33' and the endwalls 41' of the wear cap 31'. As mounted on the compaction roller 10 the sawteeth are disposed or aligned in the direction of rotation or are aligned in the direction of rotation. When the wear cap 31' and base 32' of unit 86 are pulled together, the tooth-like elements fit into mutual complementary recesses. Fastener means as mentioned above are received within the apertures 26' and thus enable the parts to nest tightly together for resisting twisting forces applied between the wear cap 31' and base 32' of the cleat 86.

Figure 20A:
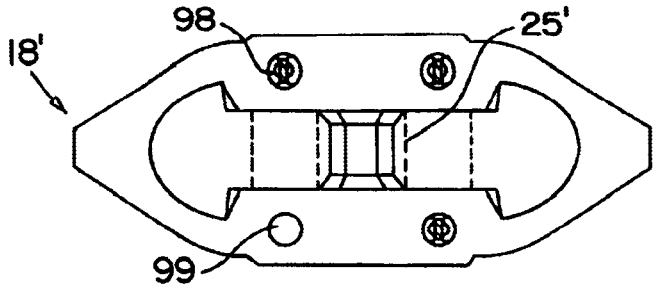
FIGS. 20*a*, 20*b* and 20*c* are related elevational view a of still another preferred form of the invention regarding a contour foot showing insertable pins or dowels serving as anti-twist means.
Figure 20B:
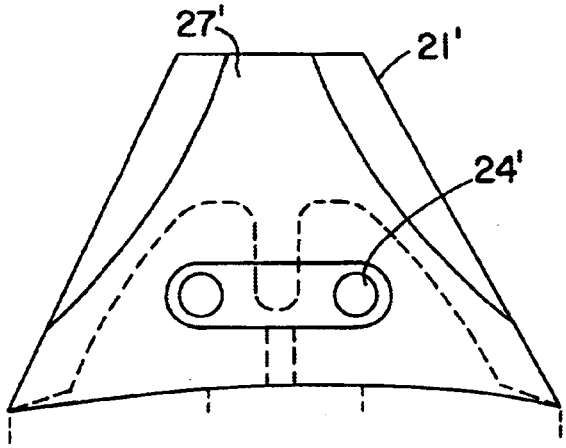
Figure 20C:
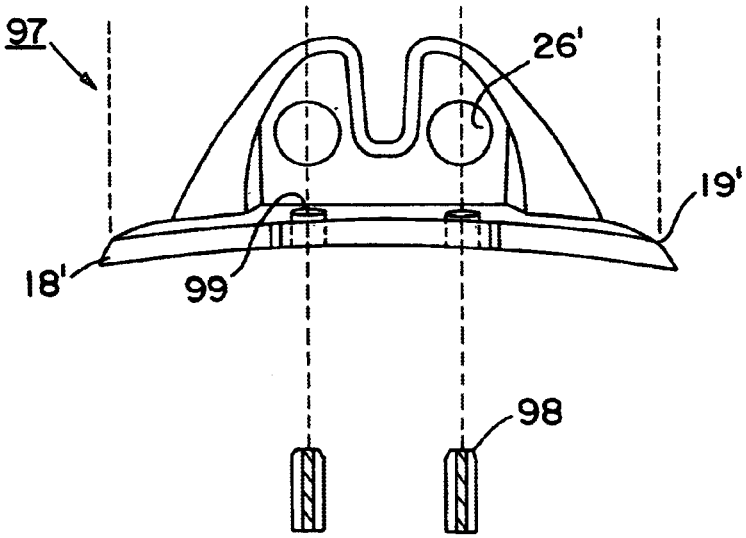

Referring now specifically to FIG. 20, another preferred form of contour cleat 97 is shown and comprises elements previously described as signified by reference numerals carrying primes. On the cleat 97 there is provided a plurality of anti-twist elements 98, each having a general configuration of a cylindrical pintle and a complimentary recess 99. These are arranged such that the recesses 99 are provided both in the base 19' of the mounting pad 18' as well as in the bottom surface of the wear cap 21', as shown. The pintle elements 98 during cleat assembly are positioned in the holes or apertures 99 and extend above the upper surface of the pad 19' so as to project into corresponding apertures or holes 99 within the wear cap. One of the advantages of this configuration is that in the foundry casting process it is necessary only to cast the recesses 99 in the two cleat parts. The pintle elements 98 may be cut from cylindrical or other shape bar stock to the desired lengths on the order ¾' to 1¾'. The length is selected so that the parts of the wear cap base and pintle 98 will all nest securely together for resisting twisting actions imparted to the wear cap and adaptor. Although two anti-twist elements are illustrated in FIG. 20, as the need dictates, three or four such elements may be provided simply by the addition of more complimentary, in registration recesses in the pad 18' and wear cap 21' of the contour cleat 97.

The pintle element 98, as an alternative to being formed from steel bar stock, may be a fabricated "flex-pin" wherein two curved metal side portions define a sandwich with a compressible somewhat elastic central member. The flex-pins when driven into the apertures 99 compress the elastic central portion, and thus establish a snug fit within the aperture 99.

On the other hand, it has been found advantageous to employ cylindrical slugs 98 which are somewhat smaller in diameter than the inside diameter of the aperture so as to accommodate easily the tolerances in general foundry casting practice. This is especially useful when two or more slug elements 98 are employed and the foundry general casting tolerance accommodates the dimensional allowance furnished by the undersized slugs or pins 98. Although it is indicated in FIGS. 20 and 21 that the anti twist means are arranged to straddle the medial axis of the traction cleats 97, 106, it is appropriate in some applications to locate the anti twist element substantially on the medial axis, especially with regard to the cleat element 97.

Figure 21A:
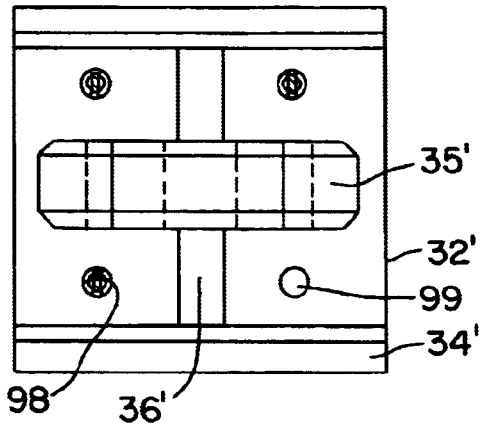
FIGS. 21*a*, 21*b* anmd 21*c* are related elevational views like those of FIGS. 20*a*, 20*b* and 20*c* but showing still another preferred form of traction cleat of the present invention showing insertable pins or dowels serving as anti-twist means.
Figure 21B:
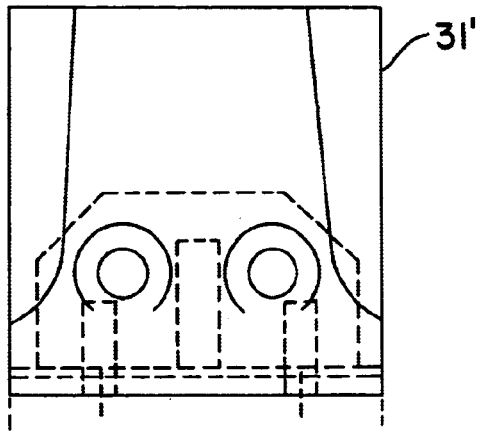
Figure 21C:
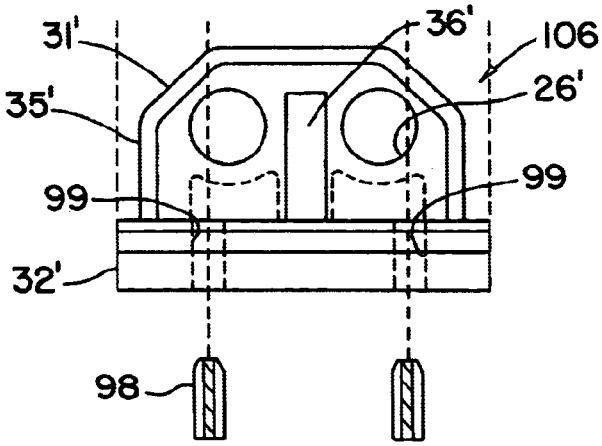

Referring to FIG. 21, another preferred form of traction cleat 106 is illustrated and includes parts previously described, thus designated with reference numerals primed. The traction cleat 106 includes a wear cap 31' and a rigid mounting pad unit 32' having a base portion 31' for welding to the wheel rim 12. A plurality of recesses 99 are formed in registry in both the cap 31' and adaptor base 32', as shown. These serve with the pintle or slug elements 98 as anti-twist means. The "flex-pins" are useful in this application as described above. The wear cap 106 is adapted to receive the connection means 22, 23 (not shown), and thus when the pins or slugs 98 are positioned in the holes or recesses 99, the wear cap 31' and adaptor 32' can be assembled in a tight fit resisting twisting forces applied to the wear cap and adaptor of the traction cleat 106 in severe usage over a long service life.

It will be further understood that in use of the compaction cleats 97, 106, normally in a sanitary land fill site, fine materials usually migrate into the interior of the cleat and wear-cap assembly such that although the pintle or slug 98 and recess 99 may initially be somewhat of a loose fit in a very short period of operational time, the interstices accumulate these fine materials which come to act as a cement uniting the pintles or pins in the recesses in both the wear cap and base. This furnishes a rigid connection. As is apparent, the anti-twist means when the cleat assembly is in use are concealed. Disassembly of the two part unit exposes the pintles for removal if necessary. A strong blow with a sledge hammer or the like will loosen the part sufficiently for removal or replacement.

From the foregoing, it will be readily evident that there have been provided improved cleat assemblies for fill and compaction rollers whereby the wear cap and associated adaptors have a long service life being that the wear caps are equipped with bulbous metal portions protruding from their plane surfaces for presenting metal in optimum locations to achieve a long wear life, as much as 20,000 useful working wear life. It will be further evident that anti-twist means are provided acting between the wear cap and adaptor to resist twisting moments there between. This further enhances the extends the service life of the cleats by substantially reducing the "working" or vibration between the wear caps and the adaptors which wears down the softer steel adapters from rubbing against the harder steel wear caps.

The embodiments disclosed herein where chosen to best explain and describe the principles of the invention and its practical application to thereby enable any others skilled in the art to best utilize the invention in various embodiments and with various modifications as are suited to the particular use contemplated. It is intended that the scope of the invention be defined by the claims appended hereto.

What is claimed:

1. A fill and compaction roller of a type having a rigid cylindrical body supported for rotation from a vehicle chassis and having cleat assemblies carried by the body, said cleat assemblies each comprising a rigid mounting pad unit having a base portion adapted to be welded to the body and a central bracket integral to said base portion protruding generally radially outwardly there from, a plurality of coupling openings extending transversely through said central bracket, a wear cap unit adapted to be readily releasably coupled to said base portion, said cap having a generally hollow body including radially outwardly convergent outer side walls, a pair of aligned openings formed through the wear cap sidewalls and disposed to be aligned with said coupling openings for receiving coupling means therethrough, coupling means disposed through said coupling openings and said aligned openings to retain said wear cap unit to said mounting pad, said wear cap unit including transverse end-walls extending between end portions of said side walls and merging therewith at corners defining four enlarged metal masses protruding outwardly from the general plane of said side walls for substantially the full height of the wear cap thus forming a pair of converging broad working faces intermediate the enlarged metal masses of said wear cap unit, said cleat assemblies including embedded means serving to restrain twisting of said wear cap unit with respect to said base portion, said means including at least three generally parallel, vertically extending cylindrical holes formed in said mounting pad and spaced apart from each other and outwardly from (of) said central bracket, and said wear cap being provided with at least three complimentary positioned and sized holes in the surface of said wear cap that supportingly engages said mounting pad, and at least three slugs positioned in said cylindrical holes and extending between the wear cap and base portion serving to inhibit twisting of said wear cap with respect to the central bracket on said base portion about an axis substantially normal through the axis of the coupling means.

2. The fill and compaction roller of claim 1 wherein said slugs are radially compressible serving to snugly fit within said holes.

3. The fill and compaction roller of claim 1 wherein the slugs fit loosely in said holes.

* * * * *